US007097271B2

(12) United States Patent
Smektala et al.

(10) Patent No.: US 7,097,271 B2
(45) Date of Patent: Aug. 29, 2006

(54) PRINTHEAD CALIBRATION

(75) Inventors: Volker Smektala, Camas, WA (US); Erik D. Ness, Vancouver, WA (US); Naoto A. Kawamura, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 182 days.

(21) Appl. No.: 10/672,424

(22) Filed: Sep. 26, 2003

(65) Prior Publication Data

US 2005/0068352 A1 Mar. 31, 2005

(51) Int. Cl.
*B41J 29/393* (2006.01)

(52) U.S. Cl. ..... 347/19; 358/504

(58) Field of Classification Search ..... 347/19, 347/14, 62; 358/504
See application file for complete search history.

(56) References Cited

U.S. PATENT DOCUMENTS

| | | | | |
|---|---|---|---|---|
| 5,418,558 | A * | 5/1995 | Hock et al. | 347/14 |
| 5,585,825 | A * | 12/1996 | Kneezel et al. | 347/14 |
| 6,145,959 | A | 11/2000 | Lund et al. | |
| 6,278,468 | B1 * | 8/2001 | Watrobski et al. | 347/14 |
| 6,302,507 | B1 * | 10/2001 | Prakash et al. | 347/14 |
| 6,533,393 | B1 | 3/2003 | Meyer et al. | |
| 6,549,947 | B1 | 4/2003 | Suzuki | |
| 6,957,879 | B1 * | 10/2005 | Moriyama et al. | 347/5 |

* cited by examiner

*Primary Examiner*—Lamson Nguyen

(57) ABSTRACT

Systems, methods, and devices are provided for printhead calibration. A method includes printing a swath. A temperature rise of a printhead is measured during the swath and an operating energy of the printhead is calibrated based on the measured temperature rise while performing a non-test print job.

32 Claims, 8 Drawing Sheets

PRINTHEAD CALIBRATION

INTRODUCTION

Printing devices, such as inkjet, laser printers, and the like, operate according to control signals, commands, and/or computer readable instruction sets to effectuate the transfer of ink onto print media. Print media comes in many forms and can include draft paper, photo paper, cardstock, letterhead, envelopes, business cards, and transparencies, among others. In an inkjet printer, one or more controllers, such as microprocessors, regulate the movement of a carriage, holding one or more inkjet pens or printheads, across a print media. The controllers further regulate the timing and firing of the ink on to the print media.

In an inkjet printer, ink is projected onto the print media through one or more inkjet printheads, each inkjet printhead containing one or more nozzles. Each printhead nozzle has an aperture and a firing resistor which heats a small quantity of ink held within the nozzle. A pulse of electrical energy is applied to the firing resistor, causing the ink within the nozzle to rapidly heat. The heat creates a vapor bubble which forms and expands within the ink. The expansion of the vapor bubble causes a droplet of ink to eject or jet through the aperture and onto the print media. The movable carriage is moved across the advancing print media in scans or swaths during printing operations. The quality of print resolution can be affected by weight variation of the ejected droplets of ink and the placement of the droplets. Poor calibration of the activation of the one or more inkjet printheads can adversely affect the consistency of ink droplet weight and placement.

DETAILED DESCRIPTION

The amount of electrical energy sufficient to heat the firing resistor and eject the ink from within the nozzle while minimizing temperature rise of the ink is often referred to as the "turn on energy" (TOE). However, the amount of turn on energy often varies from one inkjet printhead to another. A quantity of energy that is sufficient to eject ink from one inkjet printhead can be insufficient to eject ink from another inkjet printhead. For example, a particular amount of energy applied to multiple inkjet printheads can result in ink ejection from some, but not all, the inkjet printheads. Turn on energy is a characteristic of a printhead and its associated nozzle architecture. It is controlled by the resistor size, the nozzle size, and the ink chamber dimensions, among other components to the printhead. Turn on energy can be measured by, but cannot be adjusted by a printer. However, the operating energy provided to a printhead in an effort to reach the turn on energy of a printhead can be adjusted by a printer. Thus, there is a suitable energy range associated with the printhead for firing. Maintaining the amount of electrical energy supplied to inkjet printheads in this suitable range involves calibration.

When an inkjet cartridge is replaced with a new cartridge, the printhead of the new cartridge can have different firing characteristics. This disparity of firing characteristics between old and new cartridges illustrates a benefit of calibration in inkjet printers. Without proper calibration, print resolution can be impacted each time ink cartridges are replaced.

Embodiments of the present invention provide techniques for testing thermal turn on energy of inkjet printheads. Embodiments enable printhead calibration while performing a print job. That is, thermal turn on energy testing is performed during printing activities. Thermal turn on energy testing while printing is referred to as printing thermal turn on energy (P-TTOE) testing.

Figure 1:
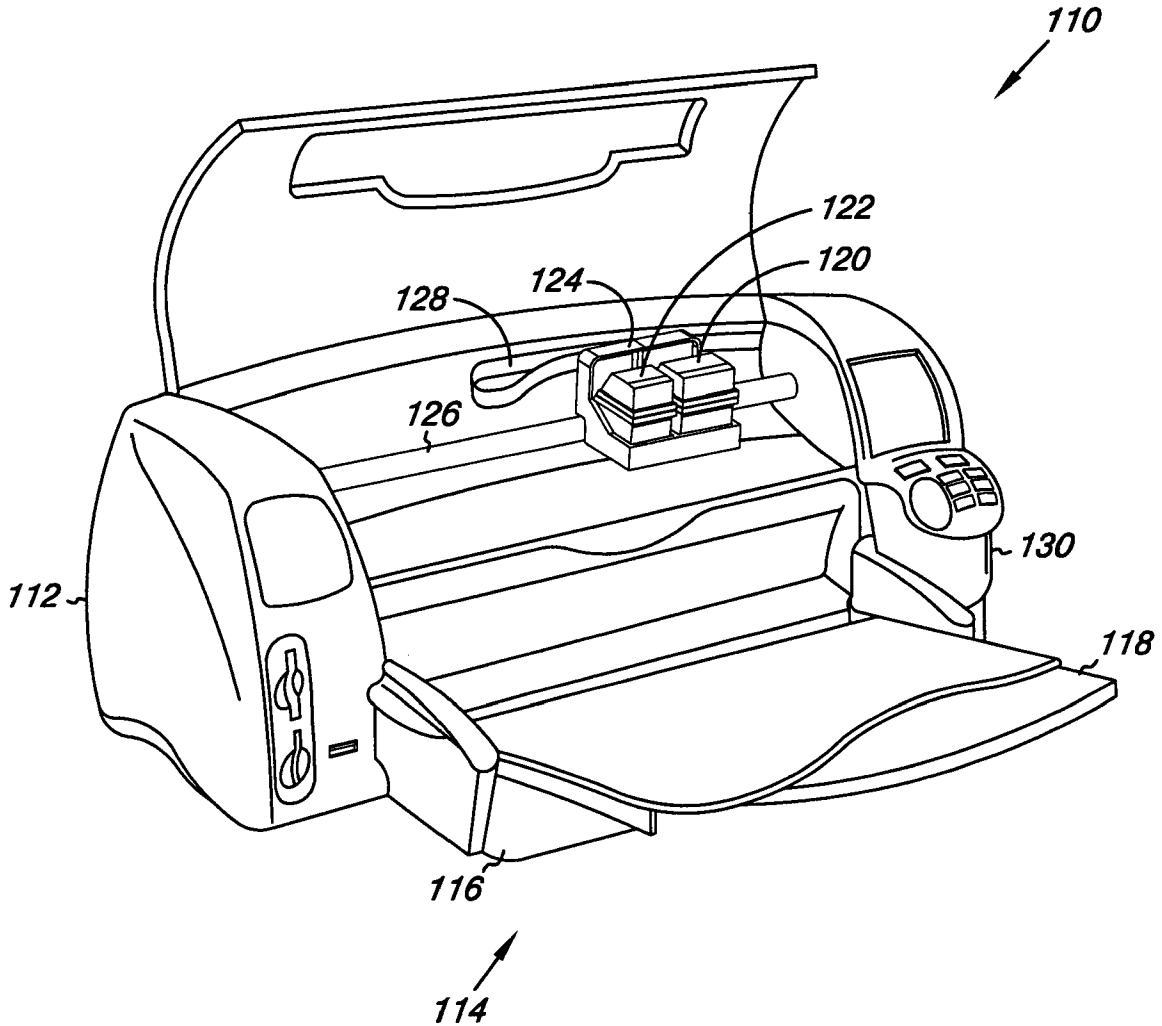
FIG. 1 illustrates a printing device with which embodiments can be implemented.

FIG. 1 provides a perspective illustration of an embodiment of a printing device, or printer, which is operable to implement or which can include embodiments of the present invention. The embodiment of FIG. 1 illustrates an inkjet printer 110, which can be used in an office or home environment for business reports, correspondence, desktop publishing, pictures and the like. However, the embodiments of the invention are not so limited and can include other printers implementing various embodiments of the present invention. In the embodiment of FIG. 1, the printer 110 includes a chassis 112 and a print media handling system 114 for supplying print media, such as a sheet of paper, business card, envelope, or high quality photo paper to the printer 110. The print media can include any type of material suitable for receiving an image, such as paper card-stock, transparencies, and the like. In the embodiment of FIG. 1, the print media handling system 114 includes a feed tray 116, an output tray 118, and a platen and rollers (not shown) for delivering sheets of print media into position for receiving ink from inkjet printhead cartridges, shown in FIG. 1 as 120 and 122. In the embodiment of FIG. 1, inkjet printhead cartridge 120 can be multi-color ink printhead cartridge and inkjet printhead cartridge 122 can be black ink printhead cartridge.

As shown in the embodiment of FIG. 1, the ink printhead cartridges 120 and 122 are transported by a carriage 124. The carriage 124 can be driven along a guide rod 126 by a drive belt/pulley and motor arrangement (not shown). The actual motor control arrangement can vary among printing devices.

In the embodiment of FIG. 1, the printhead cartridges 120 and 122 selectively deposit ink droplets on a sheet of paper or other print media in accordance with instructions received via a conductor strip 128 from a printer controller which can be located within chassis 112. The controller, shown in FIGS. 2A and 2B, (operates on a set of executable instructions) to perform tasks associated with the printer 110.

Figure 2A:
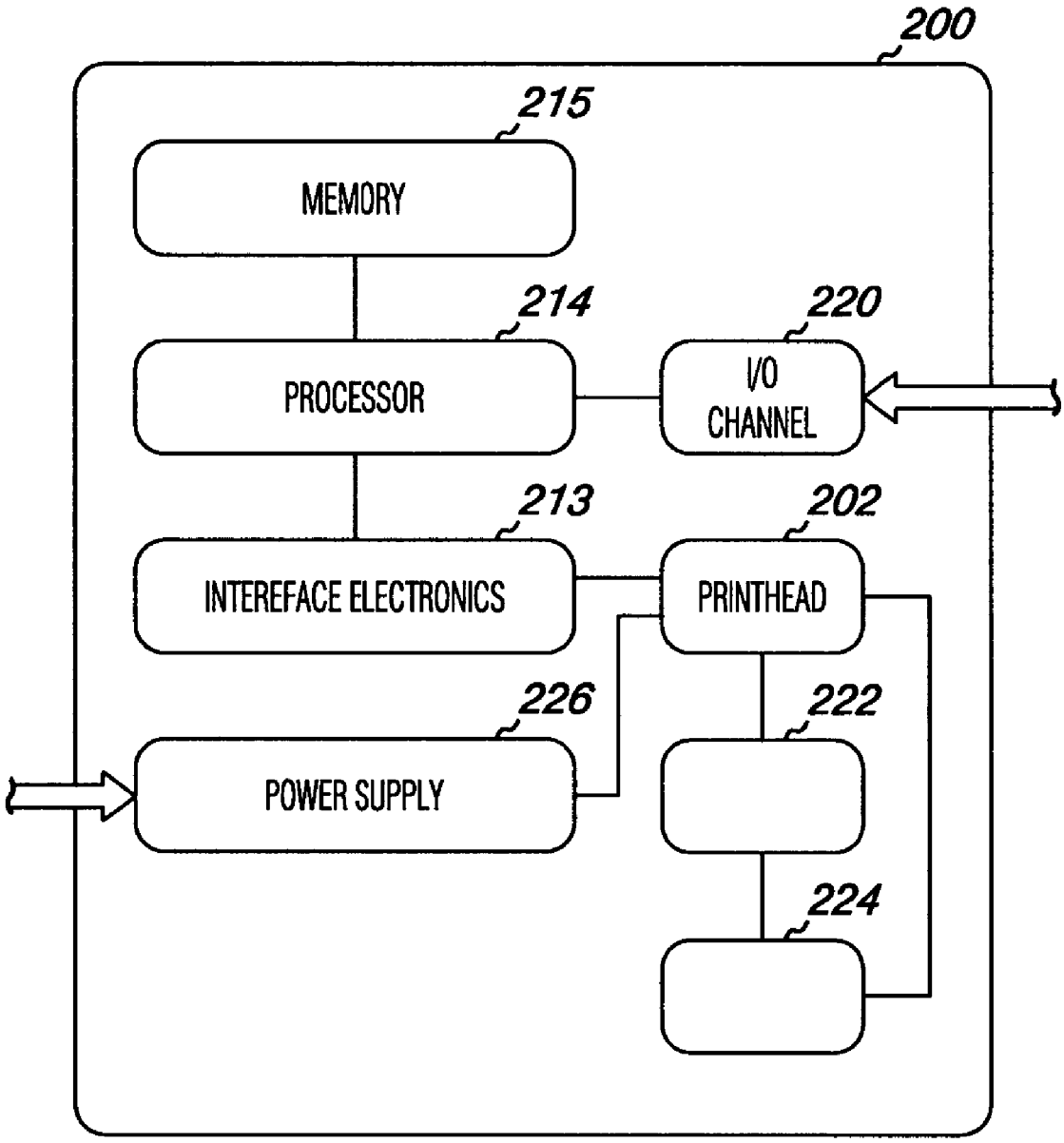
FIG. 2A illustrates an embodiment of electronic components associated with a printer.
Figure 2B:
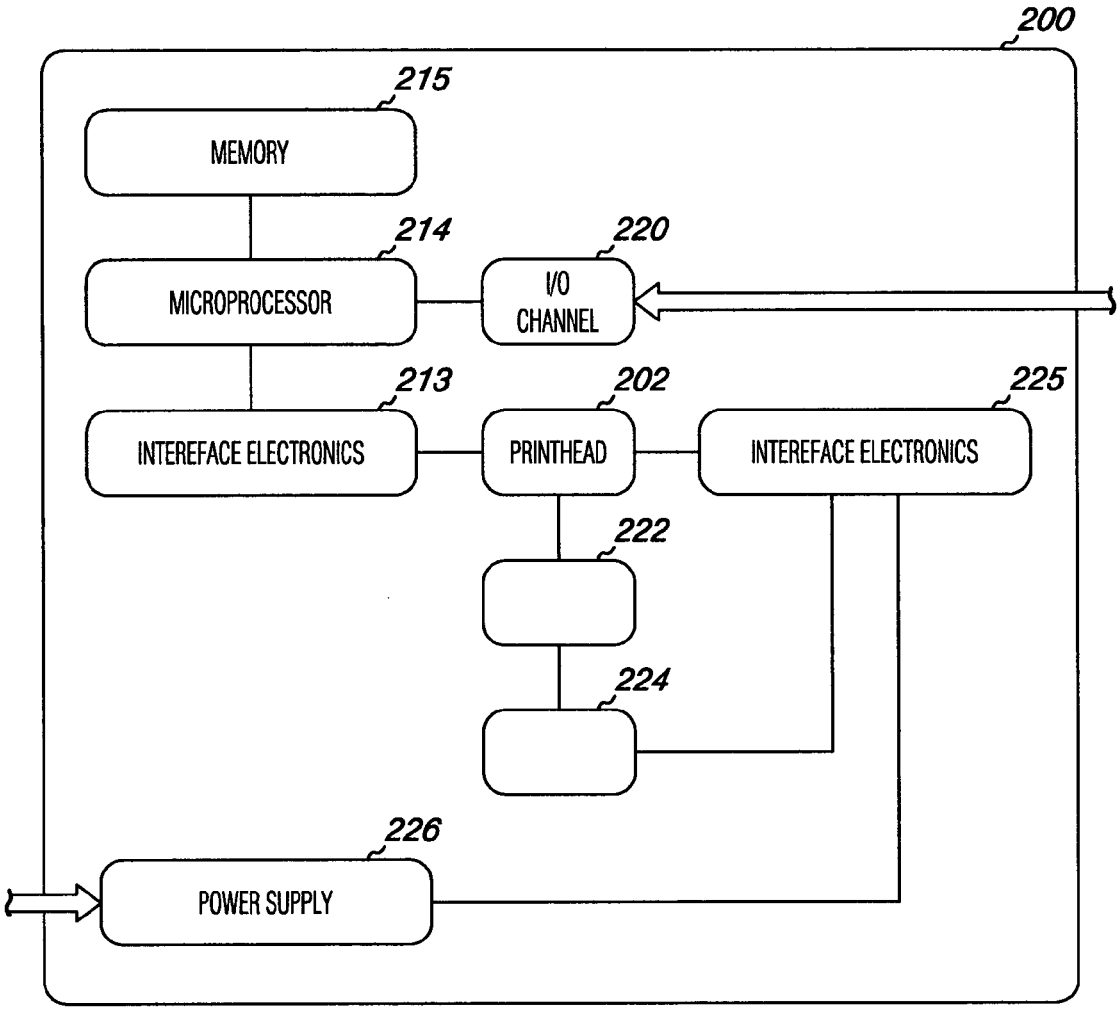
FIG. 2B illustrates another embodiment of electronic components associated with a printer.

FIGS. 2A and 2B illustrate embodiments of the electronic components associated with a printer 200, such as printer 110 in FIG. 1. As shown in the embodiments of FIGS. 2A and 2B, an inkjet printer 200 includes a printhead 202. Each printhead has multiple nozzles (shown in FIG. 3). Printer 200 includes control logic in the form of executable instructions which can exist within a memory 215 and be operated on by a controller or processor 214. The controller 214 is operable to read and execute computer executable instructions received from memory 215. Interface electronics 213 are associated with printer 200 to interface between the control logic components and the electromechanical components of the printer such as the printhead 202. Interface electronics 213 include, for example, circuits for moving the printhead and paper, and for firing individual nozzles.

The executable instructions carry out various control steps and functions for the inkjet printer 200. Memory 215 can include some combination of ROM, dynamic RAM, and/or some type of nonvolatile and writeable memory such as battery-backed memory or flash memory.

Figure 7:
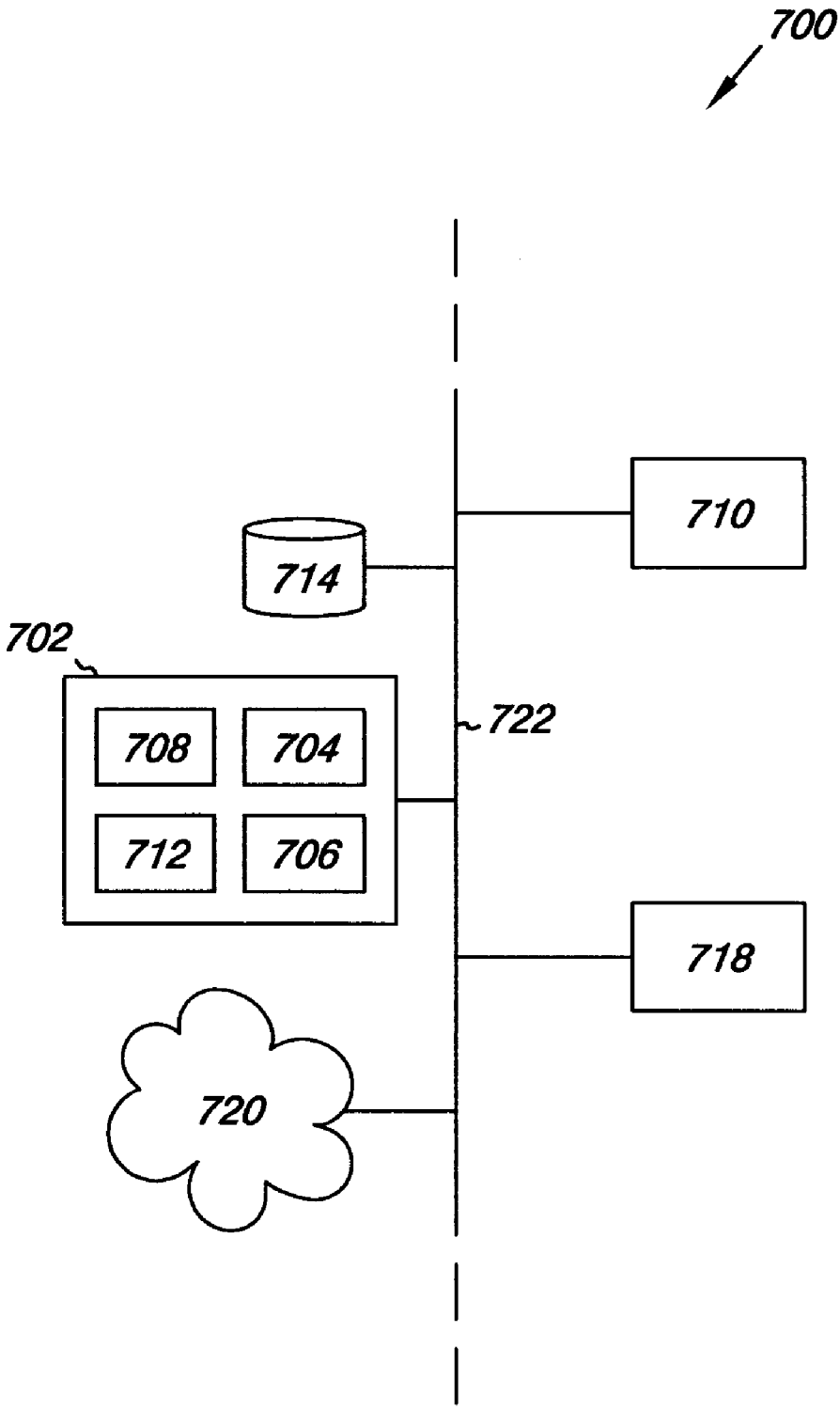
FIG. 7 illustrates a system with which embodiments can be implemented.

The controller 214 can be interfaced, or connected, to receive instructions and data from a remote device (e.g. host computer), such as 710 shown in FIG. 7, through one or more I/O channels or ports 220. I/O channel 220 can include a parallel or serial communications port, and/or a wireless interface for receiving information, e.g. print job data.

A temperature sensor 222 is provided which is operable to measure the temperature of the printhead. The temperature sensor 222 can be a thermo-couple on the printhead 202. The temperature sensor 222 can measure the temperature of the printhead while the printhead 202 is in use. That is, the temperature sensor 222 can measure the temperature rise of the printhead 202 as energy is supplied to the firing resistors associated with nozzles of the printhead 202.

As shown in the embodiments of FIGS. 2A and 2B, the electronic components include a calibration component 224 coupled to the temperature sensor 222 and printhead 202. The calibration component 224 can include software and/or firmware operable to determine, calibrate and/or set an operating energy provided to a printhead, according to the execution of one or more sets of computer executable instructions.

In various embodiments, the calibration component 224 includes a calibration component which is able to analyze a temperature rise measured on the printhead, e.g. using the temperature sensor 222, as against the thermal characteristics of the printhead. Based on this analysis, the calibration component can provide instruction for adjusting the operating energy provided to the printhead. For example, during a thermal turn on energy testing event, the calibration component 224 can receive temperature rise data for a printhead, as detected or measured by the temperature sensor 222, and can compare this measured temperature rise with an expected temperature rise.

As shown in the embodiment of FIG. 2A, a power supply 226 is provided and interfaced, or connected, to the printhead 202 to provide energy to the firing resistors in the printhead 202. Based on feedback and/or instructions from the calibration component 224, the operating energy provided on the printhead 202 to the firing resistors can be varied by adjusting the pulse length, or pulse width, of the potential applied to the firing resistors. In this manner, the energy to the firing resistors is adjusted according to the instructions to provide either more or less energy to the firing resistors. According to these instructions, the amount of energy can be increased above an expected turn on energy of the printhead to serve as a test energy.

In the embodiment of FIG. 2B, the feedback and/or instructions from the calibration component 224 is provided to additional interface electronics 225 which can control, e.g. adjust up or down, the voltage applied to the firing resistors of the printhead 202. In the embodiment of FIG. 2B, the power supply 226 is connected to the additional interface electronics 225. In this manner, the interface electronics 225 can control either the pulse width of the potential applied to the firing resistors of the printhead or can adjust that potential, or even both. Embodiments of the invention are not so limited. Thus, in the embodiments, the operating energy applied to the firing resistors of the printhead can be adjusted and controlled.

Figure 3:
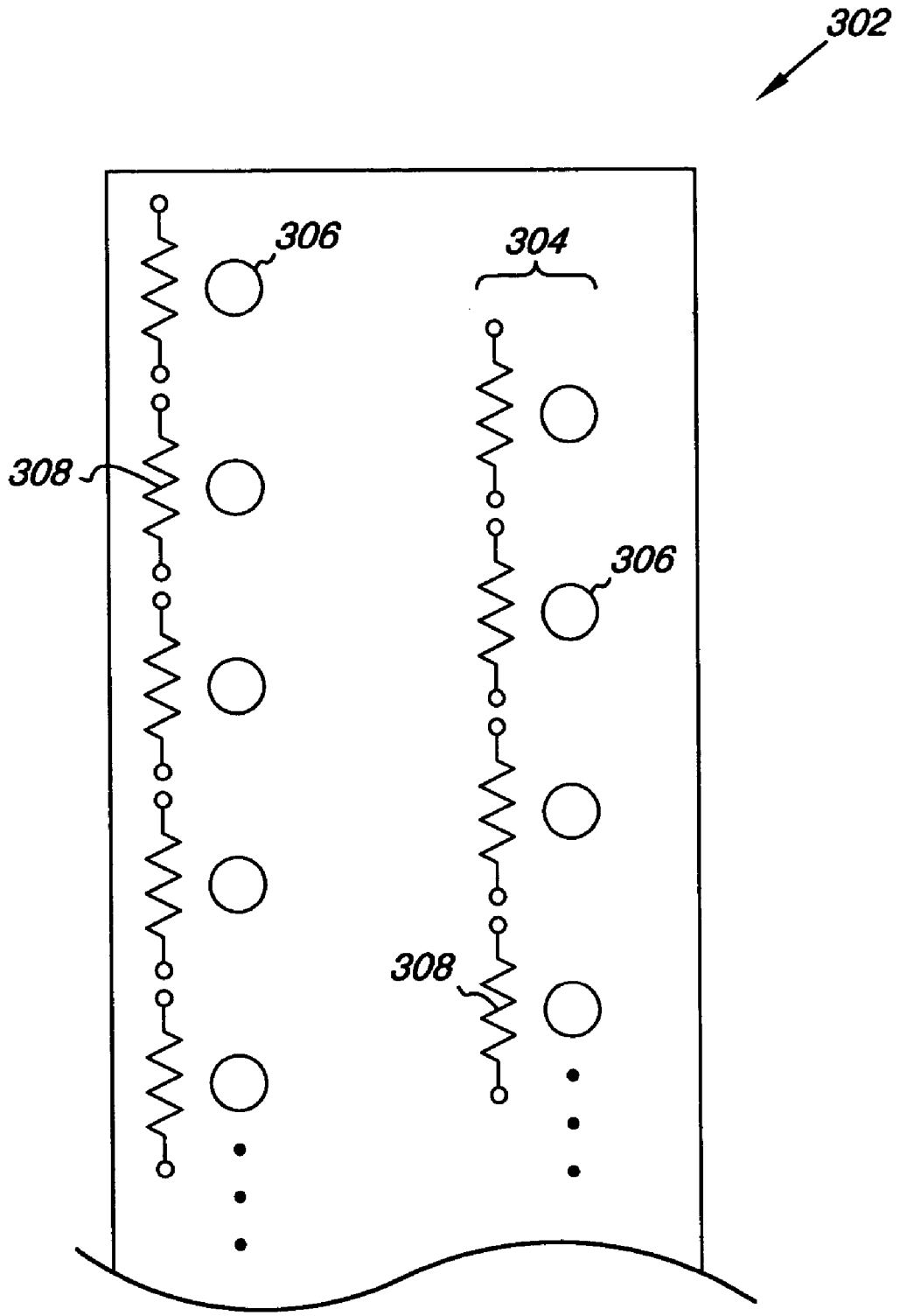
FIG. 3 illustrates a conceptual representation of an inkjet printhead with which embodiments can be implemented.

FIG. 3 illustrates a representation of an inkjet printhead 302 with which embodiments can be implemented. The inkjet printhead 302 has laterally spaced nozzle columns 304. Each of the laterally spaced nozzle columns has nozzles 306. Each of the nozzles 306 has a firing resistor 308. Each of the nozzles 306 can be located at a different position. Print media is advanced in a direction relative to the inkjet printhead 302. The inkjet printhead 302 is operable to be moved across the print media in swaths. Each of the nozzles 306 is fired repeatedly by the application of electrical energy to the firing resistor 308 causing ink within the nozzles to rapidly heat. The heat creates a vapor bubble which forms and expands within the ink. The expansion of the vapor bubble causes a droplet of ink to eject or jet through the aperture. The electrical energy supplied to the firing resistor 308 can be varied as described in connection with FIGS. 2A and 2B.

The example of the inkjet printhead 302 shown in FIG. 3 is provided for illustration, and there are many different printhead configurations possible. Implementation of the embodiments of the invention is not limited to any particular printhead configuration.

Figure 4:
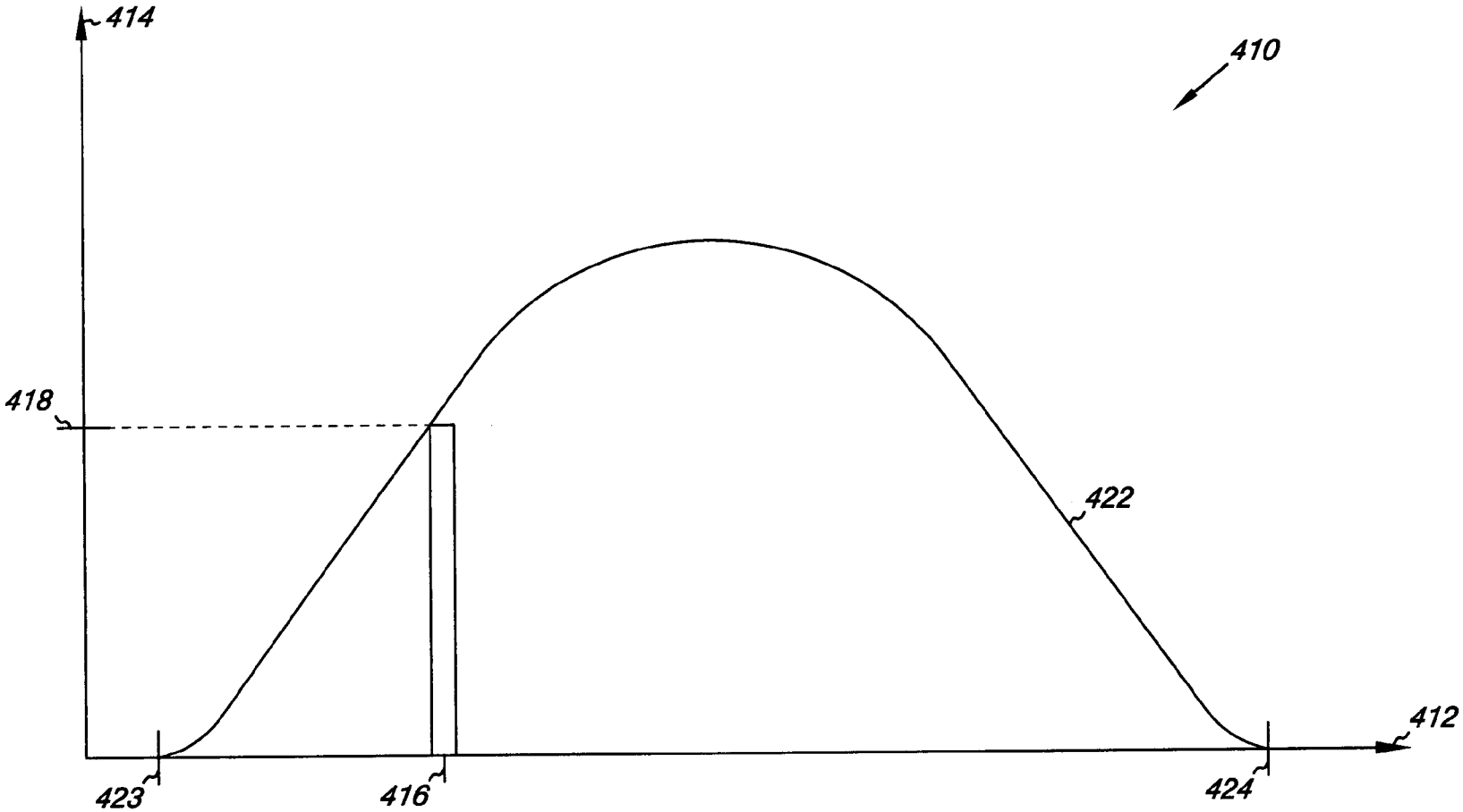
FIG. 4 illustrates an X-Y graph showing a distribution of turn on energies of a group of printheads under test.

FIG. 4 illustrates an X-Y graph showing a distribution 410 of turn on energies of a group of printheads under test. By way of illustration, in one example, 100,000 printheads are tested. Horizontal axis 412 illustrates a parameter associated with a range of turn on energy which will fire nozzles in a printhead. For example, in one embodiment the horizontal axis parameter is the amount or length of time energy is applied to the printhead nozzles. A given amount or duration of time for which energy is applied to a printhead will create a certain temperature, or thermal, rise in the printhead. The amount and/or pulse width of energy which is sufficient to cause droplets of ink to eject or jet through the aperture/nozzles of a printhead is referred to as the printheads "turn on energy" (TOE).

Vertical axis 414 illustrates that a certain number of printheads in the group of printheads will turn on for a given amount and/or pulse width of energy. The number represented on the vertical axis 414 relates to the likelihood of a randomly selected printhead from the group reaching its turn on point at a given energy level. Thus, for an energy level 416, e.g. amount and/or pulse width of energy, there is a certain number of printheads in the group of printheads, corresponding to the value 418 on the vertical axis, which will reach their turn on point. That is, in the embodiment of FIG. 4, the value 418 represents the size of the population, e.g. how many of the 100,000 printheads under test, are likely to turn on at the particular energy level 416.

As shown in the embodiment of FIG. 4, a plot of the distribution of turn on energies over a range of energy levels can take the form of a Gaussian distribution/curve 422. Thus, in this example, there is a particular "operating energy range", e.g. in the energy level range between 423 to 424, for which it can be expected that most printheads are likely to turn on. In the test example, a larger number of the printheads under test are likely to turn on when a operating energy range represented near the central portion of the distribution 422 is reached. An increasing number of printheads will reach their turn on as the operating energy applied to the resistors in a printhead is increased.

As shown in the embodiment of FIG. 4, there is an upper end energy level, or high energy point, 424 for which there is an increased likelihood that all printheads under test will achieve firing, e.g. have reached or surpassed their turn on point. In various embodiments, this high energy point can be used as a test energy to increase the likelihood of firing all of the printhead nozzles in a printer as part of a turn on energy calibration sequence.

It is possible to set an operating energy at the upper end 424 of the turn on energy scale, e.g. higher energy level, to ensure that substantially all printheads fire. However, it is not desirable to repeatedly "over drive" a printhead with more operating energy than is necessary. Repeatedly over driving a printhead can have a deleterious impact on the nozzles of a printhead.

Therefore, the energy level applied to a given printhead will generally be set at a particular "default" operating energy near the central portion of the statistical distribution 422. The pen, or printhead will then occasionally be calibrated to confirm the printhead is firing properly in a particular operating environment. In various embodiments, the above noted high energy point 424 can be used to increase the likelihood of firing all of the printhead nozzles in a printer as part of a turn on energy calibration sequence.

Figure 5:
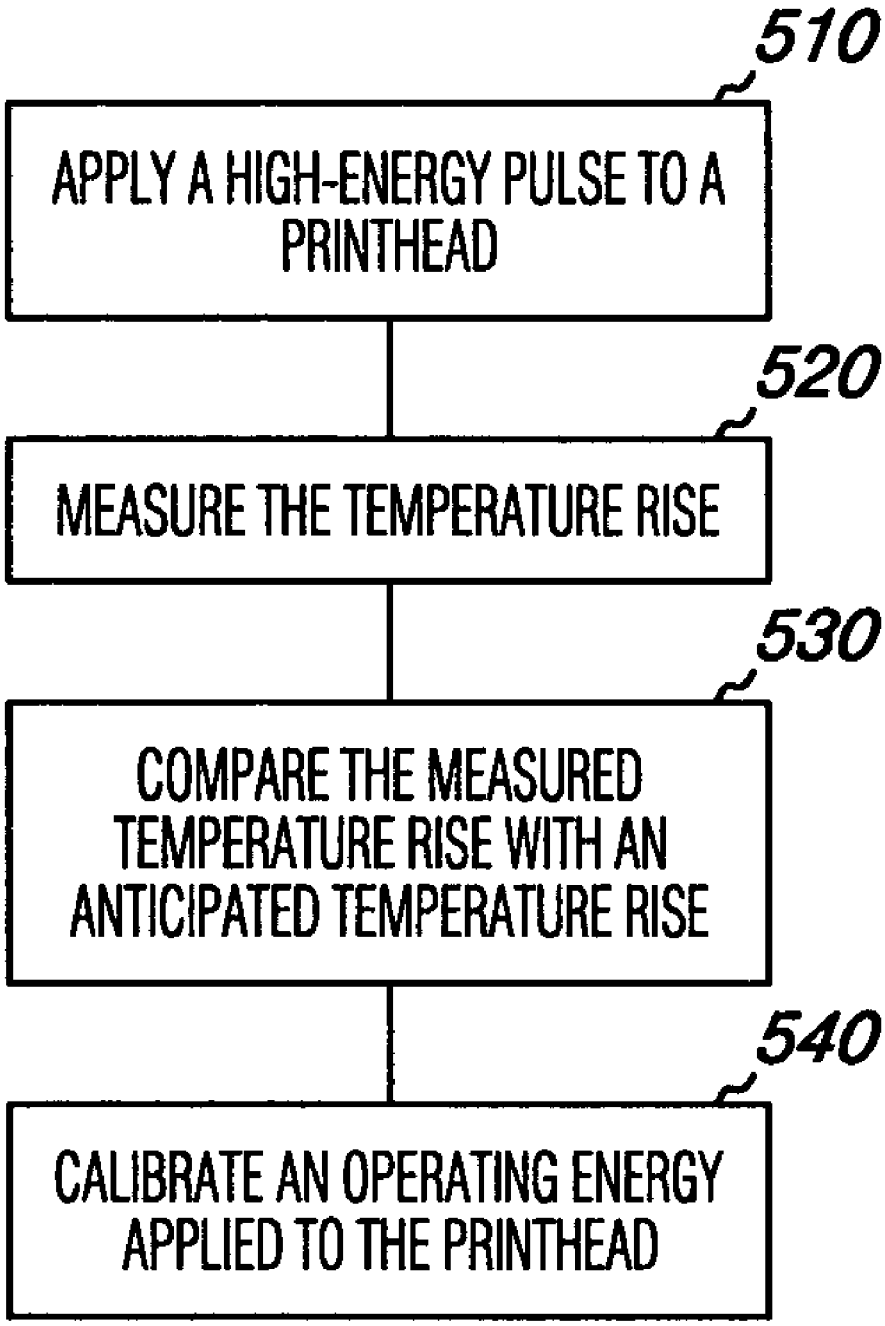
FIG. 5 illustrates a method embodiment for calibration.
Figure 6:
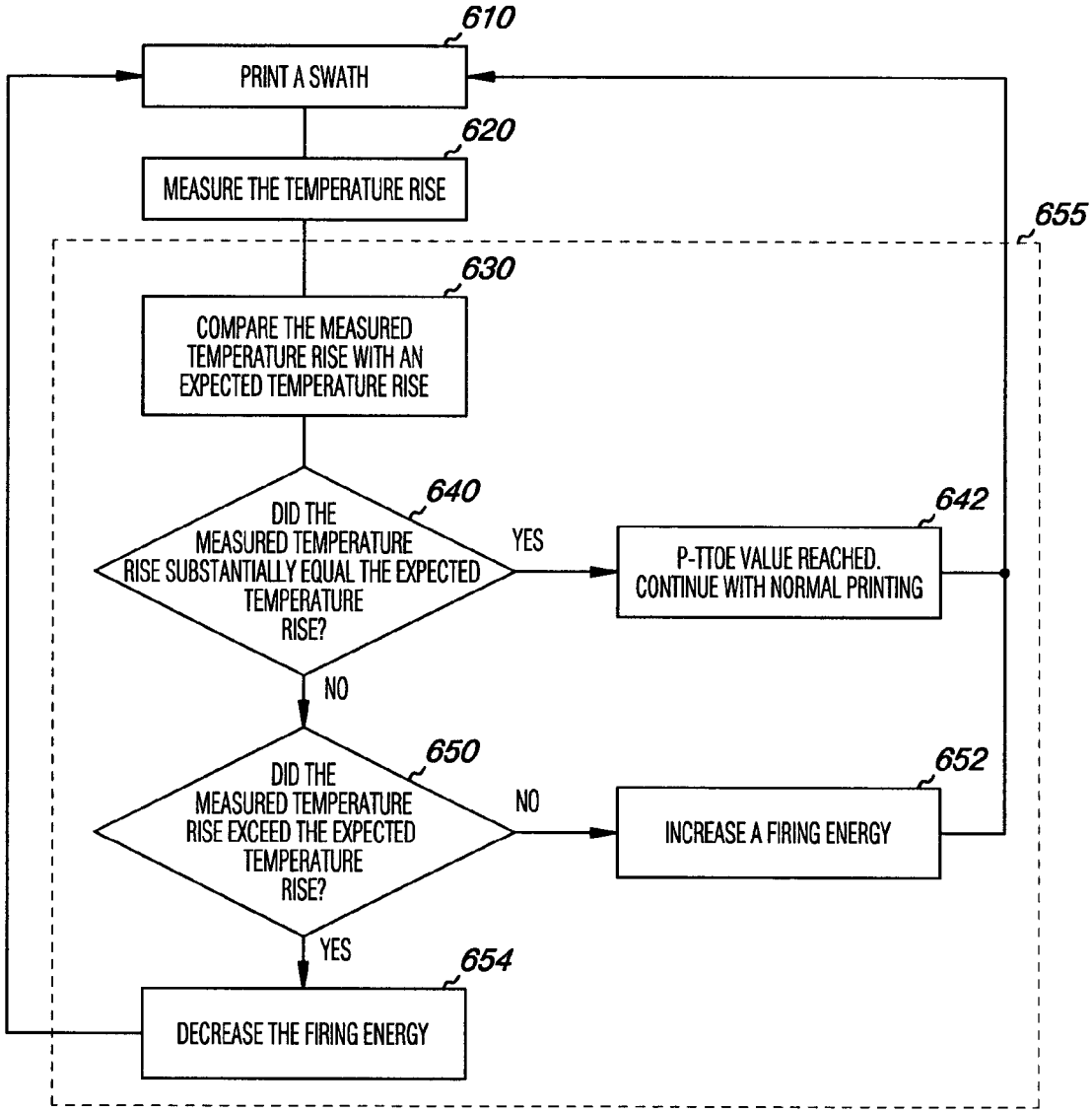
FIG. 6 illustrates a method embodiment for printing thermal turn on energy calibration.

FIGS. 5 and 6 illustrate various method embodiments for setting and/or calibrating a turn on energy for printheads. The methods can be performed by executable instructions operated on by a controller, interface electronics, and a calibration component as described above in connection with FIGS. 2A and 2B. Unless explicitly stated, the method embodiments described herein are not constrained to a particular order or sequence. Additionally, some of the described method embodiments can occur or be performed at the same point in time. The methods embodiments illustrated in connection with FIGS. 5 and 6 do not separately expend consumables or involve testing apart from printing activities.

FIG. 5 illustrates a method embodiment for calibration. As illustrated in the embodiment of FIG. 5, the method includes applying a high energy pulse to a printhead at block 510. In the embodiments, the amount of energy applied is greater than an anticipated amount of energy used to turn on or "fire" a typical printhead. Since the turn on energy can vary from one printhead to another, this greater amount of energy is applied to the one or more printheads to increase the likelihood that all of the printhead nozzles will fire. The method continues to block 520, where the temperature rise of the printhead is measured. At block 530, the measured temperature rise of the one or more printheads is compared with an anticipated temperature rise. After the measured temperature rise is compared with the anticipated temperature rise, an operating energy for the printhead can be calibrated at block 540. In various embodiments, calibrating the printhead includes adjusting the energy provided, or supplied to the printhead.

FIG. 6 illustrates a method embodiment for printing thermal turn on energy calibration. As illustrated in the embodiment of FIG. 6, the method includes printing a swath at block 610. In various embodiments, the printing swath can be performed during a normal printing pass or scan associated with executing a print job. At block 620, the method includes measuring the temperature rise of a printhead. The measured temperature rise of the printhead can be compared with an expected temperature rise in block 630. Block 640 comprises determining if the measured temperature rise of the printhead substantially equals the expected temperature rise. If the measured temperature rise substantially equals the expected temperature rise, the method can continue to block 642. Block 642 reflects that the printing thermal turn on energy (P-TTOE) value of the printhead has been reached, and printing can proceed to the next print swath, or scan, at block 610.

If the measured temperature rise did not substantially equal the expected temperature rise, the method can continue to block 650. At block 650, it can be determined if the measured temperature rise of the printhead exceeded the expected temperature rise. If the measured temperature rise did not exceed the expected temperature rise, the method can continue to block 652. At block 652, the amount of energy, e.g. firing energy, provided to the printhead can be incremented, or increased, and printing can proceed to print the next swath or scan at block 610. If the measured temperature rise of the printhead exceeded the expected temperature rise, the process can continue to block 654. At block 654, the amount of energy can be decreased, and printing can proceed to print the next swath, or scan, at block 610. Dashed box 655 illustrates an embodiment of a calibration based on the measured temperature rise.

In various embodiments, the amount of energy applied to the printhead can be adjusted by altering the pulse width of the energy provided to the printhead. The amount of energy applied to the printhead can likewise be adjusted by adjusting the applied voltage, and/or varying the energy pulses, among other techniques.

The various embodiments provide methods for measuring the turn on energy of a printhead and calibrating the operating energy during normal printing operations. In various embodiments, calibration can be executed with each print swath or scan. Operating energy can be adjusted during multiple swaths or scans, and can be continually adjusted without pausing or ceasing normal printing operations.

FIG. 7 illustrates that a printing device, including embodiments described herein, can be incorporated as part of a system 700. As shown in FIG. 7, the system includes a printing device 702, such as an inkjet printer as described herein.

The system 700 is operable to receive data and interpret the data to position an image in a particular image position. The system 700 can include software and/or application modules thereon for receiving and interpreting data in order to achieve the positioning and/or formatting functions. As one of ordinary skill in the art will appreciate, the software and/or application modules can be located on any device that is directly or indirectly connected to the printing device 702 within the system 700.

The printing device 702 can include a controller 704 and a memory 706, such as the controller and memory discussed in connection with FIGS. 2A and 2B. The controller 704 and the one or more memory devices are operable to implement the method embodiments described herein. In the various embodiments, the one or more memory devices 706, include memory devices 706 on which data, including computer readable instructions, and other information of the like can reside.

In the embodiment shown in FIG. 7, the printing device 702 can include a printing device driver 708 and a print engine 712. In various embodiments of FIG. 7, additional printing device drivers can be located off the printing device, for example, on a remote device 710. Such printing device drivers can be an alternative to the printing device driver 708 located on the printing device 702 or provided in addition to the printing device driver 708. As one of ordinary skill in the art will understand, a printing device driver 708 is operable to create a computer readable instruction set for a print job utilized for rendering an image by the print engine 712. Printing device driver 708 includes any printing device driver suitable for carrying out various aspects of the embodiments of the present invention. That is, the printing device driver can take data from one or more software applications and transform the data into a print job.

When a printing device is to be utilized to print an image on a piece of print media, a print job can be created that provides instructions on how to print the image. These instructions are communicated in a Page Description Language (PDL) to initiate a print job. The PDL can include a list of printing properties for the print job. Printing properties include, by way of example and not by way of limitation, the size of the image to be printed, its positioning on the print media, resolution of a print image (e.g. DPI), color settings, simplex or duplex setting, indications to process image enhancing algorithms (e.g. halftoning), and the like.

As shown in the embodiment of FIG. 7, printing device 702 can be networked to one or more remote devices 710 over a number of data links, shown as 722. As one of ordinary skill in the art will appreciate upon reading this disclosure, the number of data links 722 can include one or more physical and one or more wireless connections, and any combination thereof, as part of a network. That is, the printing device 702 and the one or more remote devices 710 can be directly connected and can be connected as part of a wider network having a plurality of data links 722.

In various embodiments, a remote device 710 can include a device having a display such as a desktop computer, laptop computer, a workstation, hand held device, or other device as the same will be known and understood by one of ordinary skill in the art. The remote device 710 can also include one or more processors and/or application modules suitable for running software and can include one or more memory devices thereon.

As shown in the embodiment of FIG. 7, a system 700 can include one or more networked storage devices 714, e.g. remote storage database and the like, networked to the system. Likewise, the system 700 can include one or more peripheral devices 718, and one or more Internet connections 720, distributed within the network.

The network described herein can include any number of network types including, but not limited to a Local Area Network (LAN), a Wide Area Network (WAN), Personal Area Network (PAN), and the like. And, as stated above, data links 722 within such networks can include any combination of direct or indirect wired and/or wireless connections, including but not limited to electrical, optical, and RF connections.

Memory, such as memory 706 and memory 714, can be distributed anywhere throughout a networked system. Memory, as the same is used herein, can include any suitable memory for implementing the various embodiments of the invention. Thus, memory and memory devices include fixed memory and portable memory. Examples of memory types include Non-Volatile (NV) memory (e.g. Flash memory), RAM, ROM, magnetic media, and optically read media and includes such physical formats as memory cards, memory sticks, memory keys, CDs, DVDs, hard disks, and floppy disks, to name a few.

Software, e.g. computer readable instructions, can be stored on such memory mediums. Embodiments of the invention, however, are not limited to any particular type of memory medium. And, embodiments of the invention are not limited to where within a device or networked system a set of computer instructions is stored on memory for use in implementing the various embodiments of invention.

As noted, the system embodiment 700 of FIG. 7 can include one or more peripheral devices 718. Peripheral devices can include any number of peripheral devices in addition to those already mentioned herein. Examples of peripheral devices include, but are not limited to, scanning devices, faxing devices, copying devices, modem devices, and the like.

Although specific embodiments have been illustrated and described herein, those of ordinary skill in the art will appreciate that any arrangement calculated to achieve the same techniques can be substituted for the specific embodiments shown. This disclosure is intended to cover any and all adaptations or variations of the embodiments of the invention. It is to be understood that the above description has been made in an illustrative fashion, and not a restrictive one. Combination of the above embodiments, and other embodiments not specifically described herein will be apparent to those of skill in the art upon reviewing the above description. The scope of the various embodiments of the invention includes any other applications in which the above structures and methods are used. Therefore, the scope of various embodiments of the invention should be determined with reference to the appended claims, along with the full range of equivalents to which such claims are entitled.

{No longer holds with PTO rule change} Therefore, we'll pull this paragraph going forward.

In the foregoing Detailed Description, various features are grouped together in a single embodiment for the purpose of streamlining the disclosure. This method of disclosure is not to be interpreted as reflecting an intention that the embodiments of the invention require more features than are expressly recited in each claim. Rather, as the following claims reflect, inventive subject matter lies in less than all features of a single disclosed embodiment. Thus, the following claims are hereby incorporated into the Detailed Description, with each claim standing on its own as a separate embodiment.

What is claimed is:

1. A method for calibrating a printhead, comprising:

printing a swath while providing a test energy to the printhead above an expected turn on energy for the printhead;

measuring a temperature rise of the printhead during the swath; and calibrating an operating energy of the printhead based on the measured temperature rise while performing a non-test print job.

2. The method of claim 1, wherein calibrating the operating energy includes comparing the measured temperature rise of the printhead with an expected temperature rise.

3. The method of claim 1, wherein calibrating the operating energy includes adjusting the amount of energy provided to the printhead.

4. The method of claim 3, wherein adjusting the amount of energy includes increasing a voltage potential applied to the printhead.

5. The method of claim 3, wherein adjusting the amount of energy includes decreasing a voltage potential applied to the printhead.

6. A method for setting an operating energy provided to a printhead, comprising:

applying a test energy to a printhead during a normal printing pass at an energy above an expected turn on energy of the printhead;

measuring a temperature rise of the printhead during the printing pass;

comparing the measured temperature rise of the printhead to an expected temperature rise; and calibrating the energy provided to the printhead based on the comparison.

7. The method of claim 6, wherein applying an energy above the expected turn on energy includes applying an extended pulse width to the printhead during the printing pass.

8. The method of claim 6, wherein applying an energy above the expected turn on energy includes increasing a voltage applied to firing resistors of the printhead.

9. The method of claim 6, wherein applying a test energy includes applying a test energy during execution of a normal print job.

10. The method of claim 6, wherein comparing the measured temperature rise to an expected temperature rise includes comparing the measured temperature rise with an expected temperature rise derived from a thermal turn on energy of the printhead.

11. The method of claim 6, wherein calibrating the energy provided to the printhead includes reducing a pulse width of the energy provided to the printhead.

12. A computer readable medium having a set of computer executable instructions thereon for causing a device to perform a method, the method comprising:

applying a firing energy to a printhead which is above an expected turn on energy of the printhead to increase a temperature of the printhead while printing a normal print job;

measuring a change of temperature of the printhead;

comparing the change of temperature of the printhead with an anticipated change of temperature; and calibrating an operating energy of the printhead.

13. The medium of claim 12, wherein applying a firing energy above an expected turn on energy includes applying an amount of firing energy that is greater than an amount of energy which is typically applied to the printhead while printing.

14. The medium of claim 12, wherein calibrating the operating energy of the printhead includes adjusting an applied voltage.

15. The medium of claim 12, wherein calibrating the operating energy of the printhead includes adjusting a pulse width of the operating energy.

16. A computer readable medium having a set of computer executable instructions thereon for causing a device to perform a method, comprising:

printing a swath while providing an energy to the printhead above an expected turn on energy for the printhead;

measuring a temperature rise of a printhead during the swath; and calibrating an operating energy of the printhead based on the measured temperature rise while performing a non-test print job.

17. A printing device, comprising:

a printhead;

a power supply to provide an energy to the printhead above an expected turn on energy for the printhead while printing a print swath;

a temperature sensor coupled to the printhead and operable to measure a temperature of the printhead during a normal printing scan; and a calibration component coupled to the temperature sensor and operable to variably adjust an operating energy provided to the printhead based on the temperature of the printhead measured during the printing scan.

18. The printing device of claim 17, wherein the calibration component includes a calibration component operable to determine a proper operating energy of the printhead by comparing a detected temperature rise of the printhead, measured during the printing scan, with an expected temperature rise.

19. The printing device of claim 17, wherein the calibration component is operable to calibrate an operating energy for the printhead by repeatedly comparing thermal measurements taken during one or more printing scans.

20. The printing device of claim 17, wherein the calibration component is operable to calibrate an operating energy of the printhead during normal printing.

21. The printing device of claim 17, wherein the calibration component is operable to variably adjust the operating energy provided to the printhead during normal printing.

22. The printing device of claim 17, wherein the calibration component includes a set of computer executable instructions.

23. The printing device of claim 17, wherein the calibration component is operable to variably adjust the operating energy by varying a pulse width of a potential applied to firing resistors on the printhead.

24. A printing device, comprising:

a printhead;

means for applying a high energy pulse to a printhead and determining a proper operating energy for the printhead during one or more normal printing scans; and means for comparing temperature changes of the printhead, during one or more printing scans, with an expected temperature change.

25. The printing device of claim 24, wherein means for applying a high energy pulse to a printhead and determining a proper operating energy includes a set of computer executable instructions.

26. The printing device of claim 24, wherein the means for applying a high energy pulse to a printhead and determining a proper operating energy includes a calibration component coupled to the printhead.

27. The printing device of claim 24, wherein the means for comparing temperature changes of the printhead include a printhead thermo-couple interfaced to a calibration component.

28. The printing device of claim 24, wherein the means are performed while executing a print job.

29. The printing device of claim 24, wherein the device further includes means for adjusting a firing energy provided to the printhead.

30. The printing device of claim 29, wherein the means for adjusting the firing energy includes a set of interface electronics receiving feedback from a calibration component for incrementing or decrementing a voltage potential applied to firing resistors of the printhead.

31. A printing system, comprising:

a printing device, wherein the printing device includes;

a printhead;

a temperature sensor coupled to the printhead and operable to measure thermal characteristics of the printhead during printing; and a calibration component coupled to the temperature sensor and operable to set an operating energy for the printhead at an energy above an expected turn on energy for the printhead, while the printhead is performing a normal print job, based on thermal characteristics measured during printing; and a host device connected to the printing device and operable to transmit one or more print jobs to the printing device.

32. The system of claim 31, wherein the calibration component includes a calibration component operable to compare the measured thermal characteristics detected during application of the energy above the expected turn on energy to an expected temperature rise derived from a thermal turn on energy characteristic of the printhead.

* * * * *

UNITED STATES PATENT AND TRADEMARK OFFICE

CERTIFICATE OF CORRECTION

PATENT NO. : 7,097,271 B2
APPLICATION NO. : 10/672424
DATED : August 29, 2006
INVENTOR(S) : Volker Smektala et al.

It is certified that error appears in the above-identified patent and that said Letters Patent is hereby corrected as shown below:

In column 10, line 20, in Claim 24, after "during" insert -- the --.

In column 10, line 20, in Claim 24, after "more" insert -- normal --.

Signed and Sealed this

Twenty-seventh Day of July, 2010

David J. Kappos

David J. Kappos
*Director of the United States Patent and Trademark Office*